US006726618B2

(12) United States Patent
Miller

(10) Patent No.: US 6,726,618 B2
(45) Date of Patent: Apr. 27, 2004

(54) HEARING AID WITH INTERNAL ACOUSTIC MIDDLE EAR TRANSDUCER

(75) Inventor: Scott Allan Miller, Golden, CO (US)

(73) Assignee: Otologics, LLC, Boulder, CO (US)

( * ) Notice: Subject to any disclaimer, the term of this patent is extended or adjusted under 35 U.S.C. 154(b) by 0 days.

(21) Appl. No.: 10/121,824

(22) Filed: Apr. 12, 2002

(65) Prior Publication Data

US 2002/0150268 A1 Oct. 17, 2002

Related U.S. Application Data

(60) Provisional application No. 60/283,879, filed on Apr. 12, 2001.

(51) Int. Cl.[7] ..... H04R 25/00
(52) U.S. Cl. ..... 600/25
(58) Field of Search ..... 600/25; 607/55–57; 381/68–68.3

(56) References Cited

U.S. PATENT DOCUMENTS

| | | | | |
|---|---|---|---|---|
| 3,170,046 | A | | 2/1965 | Leale |
| 3,346,704 | A | | 10/1967 | Mahoney |
| 3,594,514 | A | | 7/1971 | Wingrove |
| 3,882,285 | A | | 5/1975 | Nunley et al. |
| 4,015,607 | A | | 4/1977 | Wright, III |
| 4,817,607 | A | * | 4/1989 | Tatge ..... 623/10 |
| 4,988,333 | A | | 1/1991 | Engebretson et al. |
| 5,015,224 | A | | 5/1991 | Maniglia |
| 5,031,219 | A | | 7/1991 | Ward et al. |
| 5,085,628 | A | | 2/1992 | Engebretson et al. |
| 5,176,620 | A | | 1/1993 | Gilman |
| 5,201,007 | A | | 4/1993 | Ward et al. |
| 5,267,321 | A | | 11/1993 | Langberg |
| 5,318,502 | A | | 6/1994 | Gilman |
| 5,411,467 | A | | 5/1995 | Hortmann et al. |
| 5,558,618 | A | | 9/1996 | Maniglia |
| 5,702,342 | A | | 12/1997 | Metzler et al. |
| 5,772,575 | A | | 6/1998 | Lesinski et al. |
| 5,782,744 | A | | 7/1998 | Money |
| 5,824,022 | A | | 10/1998 | Zilberman et al. |
| 5,913,815 | A | | 6/1999 | Ball et al. |
| 6,093,144 | A | | 7/2000 | Jaeger et al. |
| 6,094,493 | A | | 7/2000 | Borowsky et al. |
| 6,099,462 | A | | 8/2000 | aWengen |

* cited by examiner

*Primary Examiner*—Samuel G. Gilbert
(74) *Attorney, Agent, or Firm*—Marsh Fischmann & Breyfogle LLP

(57) ABSTRACT

A hearing aid and method for stimulating the tympanic membrane of a patient via an input of acoustic signals into the middle ear cavity. The hearing aid includes an acoustic signal receiver, a signal processor, and an implantable transducer. In one aspect of the invention, the impedance of the implantable transducer is matched to a characteristic frequency range of the human tympanic membrane to acoustically couple the transducer with the tympanic membrane. In another aspect of the invention, the impedance of the implantable transducer is matched to a measured impedance of a patient's tympanic membrane to achieve the acoustic coupling. In either case, the acoustic signal receiver receives acoustic sounds and generates frequency response signals for the signal processor. The signal processor, in turn, processes the frequency response signals to generate transducer drive signals for the implanted transducer. The acoustically coupled transducer receives the drive signals to generate acoustic signals, e.g. acoustic sound, that are introduced into the middle ear cavity of the patient to stimulate the tympanic membrane.

38 Claims, 10 Drawing Sheets

HEARING AID WITH INTERNAL ACOUSTIC MIDDLE EAR TRANSDUCER

CROSS REFERENCE TO RELATED APPLICATIONS

This application claims priority under 35 U.S.C section 119 to U.S. Provisional Patent Application Ser. No. 60/283,879 filed on Apr. 12, 2001 titled "INTERNAL ACOUSTIC MIDDLE EAR TRANSDUCER," and which is incorporated herein by reference in its entirety.

FIELD OF THE INVENTION

The invention is related to the field of hearing aids, and in particular, to a hearing aid that includes an implantable acoustic transducer for providing acoustic signals into the middle ear cavity of a patient.

BACKGROUND OF THE INVENTION

Implantable hearing aids entail the subcutaneous positioning of some or all of various hearing augmentation componentry on or within a patient's skull, typically at locations proximal to the mastoid process. In a semi-implantable hearing aid, a microphone, signal processor, and transmitter may be externally located to receive, process, and inductively transmit a processed audio signal to an implanted receiver, while a transducer is implanted within the patient. Fully-implantable hearing aids locate the microphone, transducer, and signal processor subcutaneously. In either arrangement, a processed audio drive signal is provided to some form of actuator to stimulate a component of the auditory system, typically the ossicular chain, within the middle ear of a patient. In turn, the ossicular chain stimulates the cochlea to cause the sensation of sound in a patient.

By way of example, one type of implantable actuator includes an electromechanical transducer having a magnetic coil that drives a vibratory member positioned to mechanically stimulate the ossicular chain via physical engagement. (See e.g. U.S. Pat. No. 5,702,342). In this regard, one or more bones of the ossicular chain are made to mechanically vibrate, causing the vibration to stimulate the cochlea through its natural input, the so-called oval window. An example of such a transducer is included in the MET™ hearing aid of Otologics, LLC, developed by Fredrickson et al in which a small electromechanical transducer is used to vibrate the incus (the 2nd of the 3 bones forming the ossicles), and thence produce the perception of sound.

In another example, implanted excitation coils may be employed to electromagnetically stimulate magnets affixed within the middle ear. In each of these approaches, a changing magnetic field is employed to induce vibration. While these devices significantly improve over other devices, they still include at least one surgically achieved contact interface or mechanically fixed point with a component of the middle ear. Such mechanically fixed points may be subject to environmental pressure changes and other conditions, and therefore, are not ideal for all hearing impaired individuals. In this regard, it is desirable in the art of hearing aids to enhance the sensation of sound in hearing impaired individuals so that such individuals may have normal or very close to normal hearing function with the least amount of modification or connection of foreign devices to the auditory system.

SUMMARY OF THE INVENTION

In view of the foregoing, a primary object of the present invention is to provide an implanted hearing aid (either semi or fully implantable) in a manner that entails reduced surgical procedures and contact with the auditory system. Another object of the present invention is to provide a hearing aid that may be fitted on a patient-by-patient basis in an efficient manner.

In this regard, the present inventor has realized the desirability of a hearing aid device that utilizes an implantable acoustic transducer to stimulate the tympanic membrane of a patient, in a contact-free manner, for instance via input of acoustic signals or vibrations into the middle ear cavity. Further, in this regard, the present inventor has realized the desirability of acoustically coupling the tympanic membrane and the acoustic transducer to efficiently provide the acoustic stimulation of the tympanic membrane and thereby generate the sensation of sound using the natural mechanical advantage provided by the ossicular chain.

In carrying out the above objects of the present invention, the present inventor has further recognized that the impedance of an implanted acoustic transducer may be matched to a characteristic acoustic impedance range for human tympanic membranes to acoustically couple the transducer with a tympanic membrane. By matching the impedance of the transducer to that of the human tympanic membrane, the transducer acoustically couples for the transmission of acoustic signals with the tympanic membrane due to the impedance difference between the tympanic membrane, having relatively low impedance, and the other components of the middle ear, having relatively high impedance.

In other words, because significantly more power is required to stimulate the other components, namely, the oval window, round window, and ossicular chain, than is required for tympanic membrane stimulation, the impendence matching effectively forms an acoustic coupling with the tympanic membrane. This in turn permits the introduction of acoustic signals, generally into the middle ear cavity of a patient, that stimulates the tympanic membrane without stimulation of other components of the middle ear cavity, other than through the natural stimulation provided by the tympanic membrane (e.g. in response to stimulation by the acoustic signals the tympanic membrane stimulates the ossicular chain which in turn stimulates the cochlea to produce the sensation of sound).

In view of the foregoing, a first aspect of the present invention includes a method entailing the step of matching the impedance of an acoustic transducer to a predetermined characteristic impedance range for human tympanic membranes. The method further includes implanting the transducer proximate to the middle ear cavity of the patient and providing acoustic signals to the middle ear cavity in response to transducer drive signals. The transducer drive signals being generated in response to acoustic sound received at an acoustic signal receiver (e.g. a microphone).

In this regard, the transducer may be implanted substantially adjacent to the middle ear cavity so that the transducer may provide the acoustic signals generally into the middle ear cavity, such as, via an aperture formed therein. In the alternative, the transducer may be implanted within the mastoid process of the patient and an acoustic path provided between the transducer and the middle ear cavity. In the later case, the acoustic path may be a biocompatible tubing connected at a first end to the transducer and a distal end to the middle ear cavity, e.g. via an aperture formed therein. In some cases, the tubing may be extended slightly into the middle ear cavity to prevent occlusion caused by tissue growth over the interfacing end of the tubing. In another example, the interfacing end of the tubing may be formed at an angle to further deter occlusion caused by tissue growth. Similarly, other methods, such as disposing a sound transmitting material over the interfacing end of the tubing may also be utilized to prevent occlusion by tissue growth.

In a second aspect of the present invention, a method is provided that includes the steps of measuring an impedance of a patient's tympanic membrane and matching the impedance of an acoustic transducer to the measured impedance of the patient's tympanic membrane. In this regard, the method further includes, implanting the transducer proximate to the middle ear cavity of the patient and providing acoustic signals to the middle ear cavity in response to transducer drive signals. The transducer drive signals being generated in response to acoustic sound received at an acoustic signal receiver (e.g. a microphone).

As with the above-described method, the transducer may be implanted substantially adjacent to the middle ear cavity so that the transducer may provide the acoustic signals generally into the middle ear cavity, such as, via an aperture formed therein. In the alternative, the transducer may be implanted within the mastoid process of the patient and an acoustic path, e.g., biocompatible tubing, provided between the transducer and the middle ear cavity. The tubing may be extended slightly into the middle ear cavity and/or the interfacing end of the tubing formed at an angle to prevent occlusion caused by tissue growth. Similarly, other methods, such as disposing a sound transmitting material over the interfacing end of the tubing may also be utilized to prevent occlusion by tissue growth.

In a third aspect of the present invention, a method is provided that includes the steps of coupling an implantable transducer to a middle ear cavity of the patient. The coupling may include implanting the transducer substantially adjacent to the middle ear cavity so that the transducer may provide the acoustic signals generally into the middle ear cavity, such as, via an aperture formed therein. In the alternative, the transducer may be implanted within the mastoid process of the patient and an acoustic path, e.g., biocompatible tubing, provided between the transducer and the middle ear cavity. The tubing may be extended slightly into the middle ear cavity and/or the interfacing end of the tubing formed at an angle to prevent occlusion caused by tissue growth. Similarly, other methods, such as disposing a sound transmitting material over the interfacing end of the tubing may also be utilized to prevent occlusion by tissue growth.

The method further includes, receiving acoustic sound in an acoustic signal receiver and generating transducer drive signals in response to receiving the acoustic sound. In this regard, the method further includes, in the transducer, providing acoustic signals to a middle ear cavity of the patient in response to the acoustic drive signals and damping the acoustic signals to provide damped acoustic signals to the middle ear cavity of the patient. The damping step substantially removes resonant components of the acoustic signal so that the damped acoustic signal is substantially free from such resonant components thereby increasing the quality of hearing perception for the patient.

In a fourth aspect of the present invention, a method is provided that includes the steps of coupling an implantable transducer directly to a middle ear cavity of the patient. The method further includes receiving acoustic sound in an acoustic signal receiver and generating transducer drive signals in response to receiving the acoustic sound. In this regard, the method includes, in the transducer, providing acoustic signals to the middle ear cavity of the patient in response to the acoustic drive signals.

In accordance with this aspect of the invention, the transducer may include a substantially non-resonant coupling mechanism to introduce acoustic signals to the middle ear cavity of the patient that are substantially free of resonant components. The non-resonant coupling mechanism may be a compliant structure that is acoustically transparent. In other words, the non-resonant mechanism permits the introduction of the acoustic signals directly into the middle ear cavity of the patient to substantially eliminate the introduction of resonant components. Further, in this regard, the non-resonant coupling mechanism may be a substantially conformal wall that minimizes contamination of the transducer, but does not include other structure that introduces resonant components into the acoustic signals. In one example of the present aspect, the non-resonant coupling mechanism is a titanium diaphragm disposed on the transducer between the transducer and an aperture in the middle ear cavity of the patient.

In a fifth aspect of the present invention, a hearing aid having an acoustic signal receiver, a signal processor, and an implantable acoustic transducer is provided. In this regard, the impedance of the transducer is matched to the characteristic frequency range of the human tympanic membrane to acoustically couple the transducer and tympanic membrane. In the alternative, the impedance of the transducer may be matched to a measured impedance of an individual patient's tympanic membrane to achieve the acoustic coupling.

The acoustic signal receiver is configured to receive acoustic sounds and generate frequency response signals for the signal processor. The signal processor, in turn, processes the frequency response signals to generate transducer drive signals for the transducer. The transducer, in response to the drive signals, generates acoustic signals that are introduced into the middle ear cavity of the patient to stimulate the tympanic membrane.

As with the above-described aspects, the transducer may be implanted adjacent to the middle ear cavity with access provided for the introduction of acoustic signals via an aperture formed therein. In the alternative, the transducer may be implanted within the mastoid process of the patient and an acoustic path provided, such as biocompatible tubing, for introduction of acoustic signals to the middle ear cavity. The tubing may also be extended slightly into the middle ear cavity and/or the interfacing end of the tubing formed at an angle to deter tissue growth. Similarly, other methods, such as disposing a sound transmitting material over the interfacing end of the tubing may also be utilized to prevent occlusion caused by tissue growth.

In a sixth aspect of the present invention, a hearing aid having an acoustic signal receiver, a signal processor, and an implantable acoustic transducer is provided. In this regard, the transducer is implanted substantially adjacent to the middle ear cavity of the patient to permit the direct introduction of acoustic signals into the middle ear cavity. In accordance with this aspect, the transducer may include a substantially non-resonant coupling mechanism as described above to introduce acoustic signals to the middle ear cavity of the patient that are substantially free of resonant components.

As with the above-described aspects, the acoustic signal receiver is configured to receive acoustic sounds and generate frequency response signals for the signal processor. The signal processor, in turn, processes the frequency response signals to generate transducer drive signals for the transducer.

In a seventh aspect of the present invention, a hearing aid having an acoustic signal receiver, a signal processor, and an implantable acoustic transducer is provided. In this regard, the hearing aid may include a damping element to substantially dampen resonant components of the acoustic signals. As with the above-described aspects, the transducer may be implanted adjacent to the middle ear cavity with access provided for the introduction of acoustic signals via an aperture formed therein. In the alternative, the transducer may be implanted within the mastoid process of the patient and an acoustic path provided, such as biocompatible tubing, for introduction of acoustic signals to the middle ear cavity. In the case where the transducer is implanted adjacent to the middle ear cavity, the damping element may be provided in the transducer or in the signal processor. In the case where the transducer is implanted within the mastoid process of the patient, and an acoustic path provided, the damping element may be included in either the transducer or the acoustic path.

The damping element may be any element that removes or substantially removes resonant components of the acoustic signal. In this characterization, the damping element may be in the form of a resistor that shapes the transducer drive signals to minimize vibration of the acoustic signals. In another example, the damping element may be in the form of a porous material, such as porous foam included in the transducer or the acoustic path. In another example, the damping element may be included in the transducer and include a sealing wall disposed in a chamber of the transducer that includes a sound transmitting orifice defined therein. In this characterization, the damping element may further include an isolating diaphragm disposed within the chamber between the acoustic path and the sealing wall to dampen resonant components in combination with the sealing wall.

As with the above-described aspects, the acoustic signal receiver is configured to receive acoustic sounds and generate frequency response signals for the signal processor. The signal processor, in turn, processes the frequency response signals to generate transducer drive signals for the transducer.

As will be further described below, the present invention may be utilized in conjunction with either fully or semi-implantable hearing aid devices. In semi-implantable hearing aid applications, acoustic sounds may be inductively coupled to the implanted transducer via an external transmitter and implanted receiver. In fully-implantable applications, the acoustic sounds may be received by an implanted acoustic signal receiver e.g. an omni-directional microphone, and provided to an implanted signal processor for generation of the transducer drive signals. Additional aspects, advantages and applications of the present invention will be apparent to those skilled in the art upon consideration of the following.

DETAILED DESCRIPTION

Reference will now be made to the accompanying drawings, which at least assist in illustrating the various pertinent features of the present invention. Although the present invention will now be described primarily in conjunction with semi-implantable hearing aid systems, it should be expressly understood that the present invention is not limited to this application, but is equally applicable to fully-implantable hearing aid systems.

Figure 1:
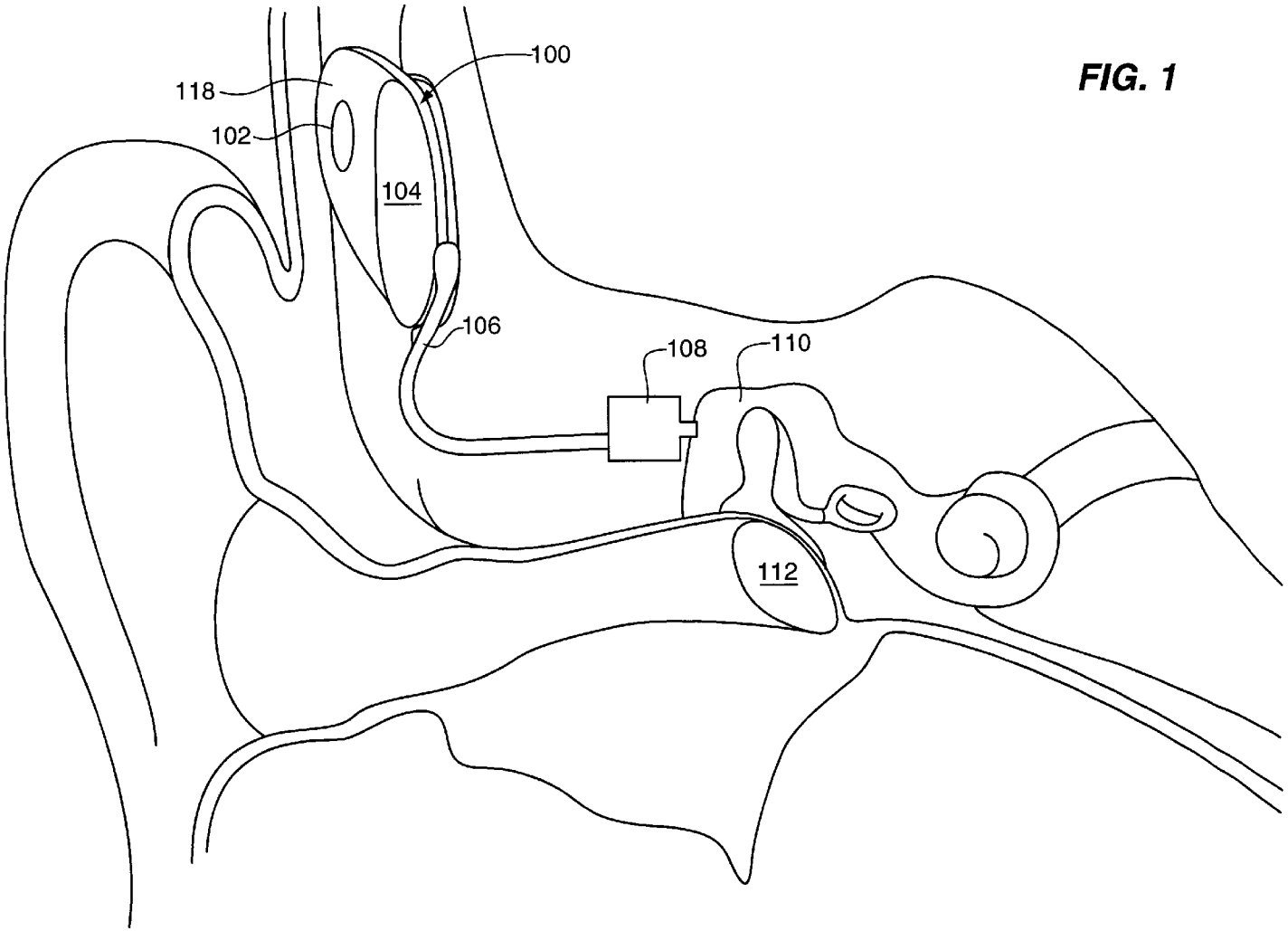
FIGS. 1 and 2 illustrate implantable and external componentry respectively, of a semi-implantable hearing aid system according to the present invention.
Figure 2:
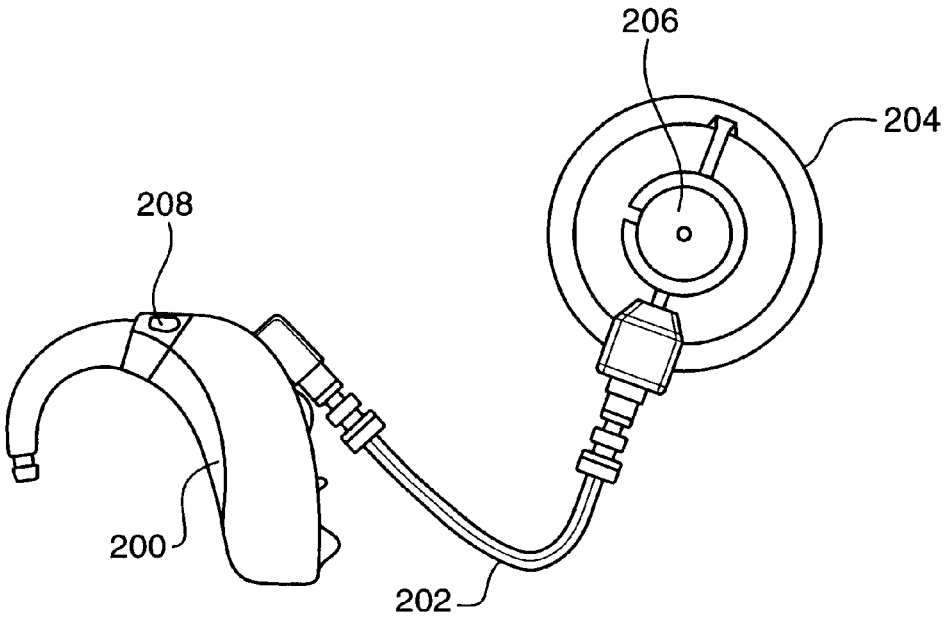

FIGS. 1 and 2 illustrate one example of the present invention. The illustrated example comprises a semi-implantable hearing aid system having implanted components shown in FIG. 1, and external components shown in FIG. 2. As will be appreciated, the present invention may also be employed in conjunction with fully implantable systems, wherein all components of the hearing aid system are located subcutaneously.

In the illustrated system, an implanted biocompatible housing 100 is located subcutaneously on a patient's skull. The housing 100 includes an RF signal receiver 118 (e.g. comprising a coil element) and a signal processor 104 (e.g. comprising processing circuitry and/or a microprocessor). The signal processor 104 is electrically interconnected via path 106 to an acoustic transducer 108. As will become apparent from the following description various processing logic and/or circuitry may be included in the housing 100 according to the different embodiments of the present invention.

The transducer 108 is mounted within a patient's mastoid process (e.g. via a hole drilled through the skull). The transducer 108 may be mounted adjacent to the middle ear cavity 110, as illustrated in FIG. 1, or alternately may be mounted just under the skin within the mastoid process. In the latter regard, an acoustic path is provided to deliver acoustic signals from the transducer 108 to the middle ear cavity 110. The acoustic transducer 108 may be any of a number of technologies in accordance with the principles of the present invention further described below. Some examples of the transducer 108 include without limitation, an electromagnetic, an electrodynamic, and/or piezoelectric transducer, etc.

Referring to FIG. 2, the semi-implantable system further includes an external housing 200 comprising an acoustic signal receiver 208 (e.g. omni-directional microphone) and speech signal processing (SSP) unit not shown. The SSP unit is electrically interconnected via wire 202 to an RF signal transmitter 204 (e.g. comprising a coil element). The external housing 200 is configured for disposition around the rearward aspect of a patient's ear. The external transmitter 204 and implanted receiver 118 each include magnets, 206 and 102 respectively, to facilitate retentive juxtaposed positioning.

During operation, acoustic signals are received at the acoustic signal receiver 208 and processed by the SSP unit within external housing 200. As will be appreciated, the SSP unit may utilize digital processing to provide frequency shaping, amplification, compression, and other signal conditioning, including conditioning based on patient-specific fitting parameters. In turn, the SSP unit via wire 202 provides RF signals to the transmitter 204. Such RF signals may comprise carrier and processed acoustic drive signal portions. The external transmitter 204 transcutaneously transmits the RF signals to the implanted receiver 118. As noted, the external transmitter 204 and implanted receiver 118 may each comprise coils for inductively coupling the signals.

Upon receipt of the RF signal, the implanted signal processor 104 processes the signals (e.g. via envelope detection circuitry) to provide processed drive signals via path 106 to the acoustic transducer 108. The drive signals cause the transducer 108 to generate and provide acoustic signals, e.g. acoustic sound, to the middle ear cavity 110 of the patient. The acoustic signals, in turn, vibrate the air in the middle ear cavity 110 exciting the tympanic membrane 112, which causes the ossicular chain to vibrate and thereby stimulate the cochlea leading to the sensation of sound in the patient.

In one embodiment of the present invention, the transducer 108 is acoustically coupled to the tympanic membrane 112 of the patient. Advantageously, such acoustic coupling with the tympanic membrane 112 permits utilization of the natural mechanical movement of the ossicular chain to cause the sensation of sound in the patient. The acoustic coupling is achieved by matching the impedance of the transducer 108 to a characteristic impedance range (range of impedance for a human tympanic membrane). Alternatively, the acoustic coupling may be achieved by matching the impedance of the transducer 108 to a measured impedance of an individual patient's tympanic membrane, e.g. tympanic membrane 112.

In this regard, in response to drive signals from the signal processor 104, the transducer 108 generates the acoustic signals in the form of vibrations at the respective frequencies generated by the signal processor 104. These acoustic signals are thereafter introduced into the middle ear cavity 110. As will be appreciated, when the acoustic signals or vibrations contact the components of the middle ear cavity, the frequencies shift as a function of the acoustical impedance of the respective component. In the case of significantly high impedance in the contacting component, such frequency shifting results in a nullification or absorption of the frequency. Matching the impedance of the transducer 108 with the characteristic impedance range of human tympanic membranes e.g. tympanic membrane 112, reduces the amount of frequency shift at the tympanic membrane 112, which effectively acoustically couples the transducer 108 and tympanic membrane 112. In other words, the acoustic vibrations do not stimulate other components of the middle ear cavity 110 because of the acoustic impedance difference between the tympanic membrane, e.g. membrane 112, and other components of the middle ear cavity 110.

In this regard, acoustic impedance is a ratio of pressure to flow. It is generally accepted that the pressure generated by the stapes to drive the oval window (in other words overcome the acoustic impedance of the same) is as much as 25 db larger than the pressure required to drive the tympanic membrane (overcome the acoustic impedance of the same). In the context of the transducer 108, this translates into a low power transducer required to drive the tympanic membrane 112, when the impedance of the transducer 108 is matched to the characteristic impedance range for human tympanic membranes e.g. tympanic membrane 112. In other words, impedance matching with the tympanic membrane 112 effectively ensures that the acoustic signals provided by the transducer 108 are substantially only detected by the tympanic membrane 112. Such acoustic signals in turn, cause the perception of sound through the natural stimulation of the ossicular chain, round window, and cochlea, as the acoustic signals generated by the transducer 108 are not strong enough to directly stimulate theses components.

Figure 3:
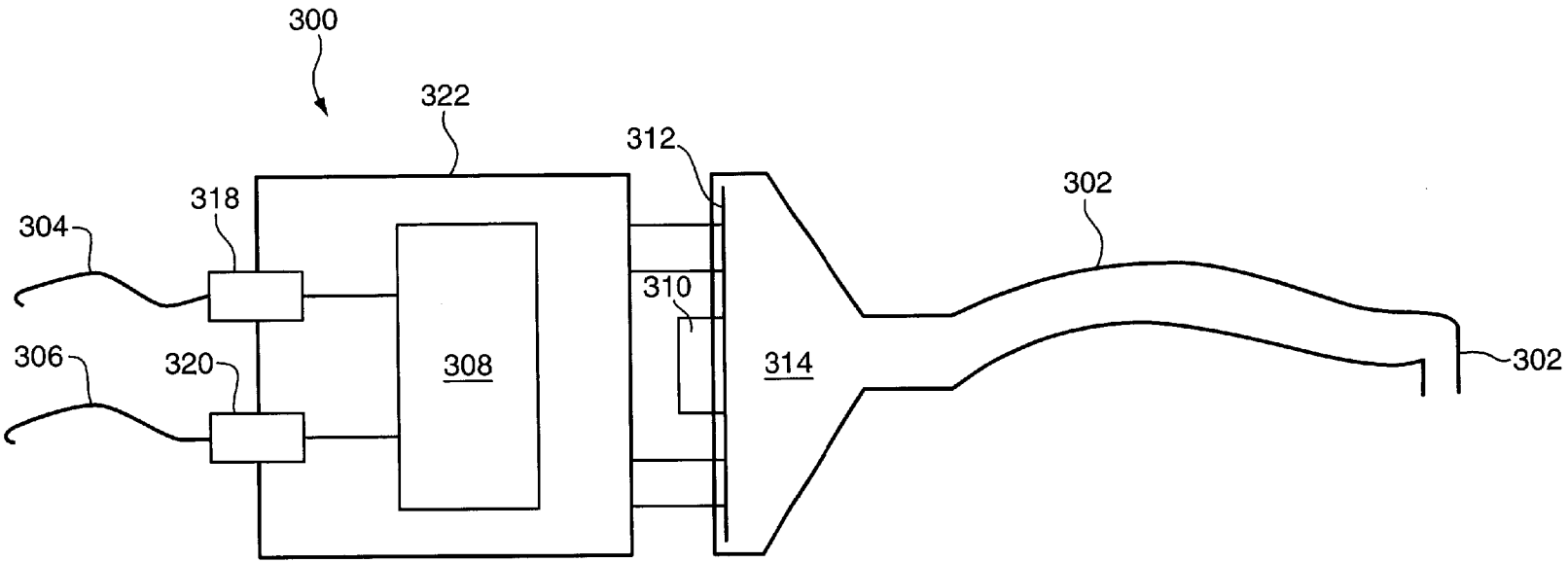
FIG. 3 illustrates an example of a transducer according to the present invention.
Figure 4:
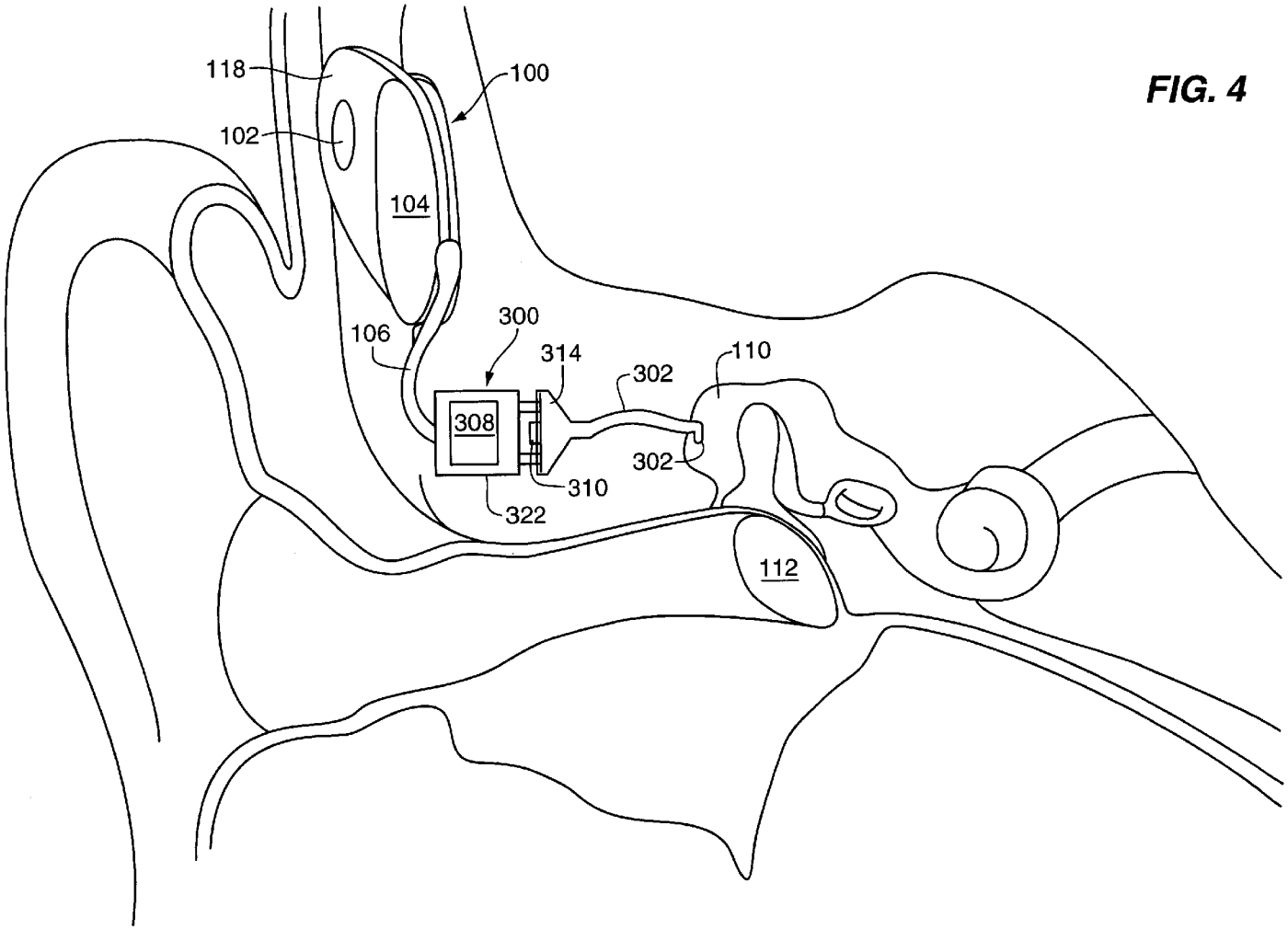
FIG. 4 illustrates an example of a hearing aid incorporating the transducer of FIG. 3.

Referring to FIGS. 3 and 4, to allow for acoustic stimulation of the tympanic membrane 112, one embodiment of the present invention provides for the use of an implanted electromagnetic acoustic transducer 300 and corresponding acoustic path 302. It should be noted that the transducer 300 is an example of the transducer 108, described above to illustrate the broad concept of the present invention.

The transducer 300 may be implanted within a patient's mastoid process and utilize the acoustic path 302 for transmission of acoustic signals to the middle ear cavity 110. Alternatively, the transducer 300 may be implanted adjacent to the middle ear 110 to provide direct input of acoustic signals into the middle ear cavity 110. In this regard, the feed wires, 304 and 306, which may be included in the path 106, carry transducer drive signals to the transducer 300 to yield the desired acoustic output. More specifically, such drive signals may be provided through feedthroughs, 318 and 320, to a coil 308 and a magnet 310. The coil 308 and magnet 310, in turn, drive an acoustic diaphragm 312 to produce the desired acoustic output to the middle ear cavity 110 via the path 302. It should be noted that the housing 322 and magnet 310 are preferably hermetically sealed to protect from contamination by bodily fluids and tissue.

In a transducer, such as transducer 300, impedance matching with the characteristic impedance range of human tympanic membranes or with the impedance of an individual patient's tympanic membrane, e.g. membrane 112, is a function of the area of the acoustic diaphragm 312, which in turn produces the acoustic input for transmission over the acoustic path 302. In this regard, it will be appreciated that an area of the acoustic diaphragm 312 that achieves desired acoustic impedance is predeterminable. According to one example of the present invention, a substantially round diaphragm having an area in the magnitude range of 0.5 milimeters squared and 400 hundred millimeters squared may be included in the transducer 300. Such a diaphragm could be used to construct a transducer with acoustic impedance in the magnitude range of $2\times10^4$ and $5\times10^8$ Pascal (PA) seconds per cubic meter. More preferably, such a diaphragm could be used to construct a transducer with acoustic impedance in the magnitude range of $2\times10^4$ and $5\times10^7$ Pascal (PA) seconds per cubic meter. As may be appreciated, such acoustic impedance range corresponds to the characteristic impedance range for the human tympanic membrane, e.g. tympanic membrane 112.

In another example of the present invention, an audiologist or other professional may measure the impedance of an individual patient's tympanic membrane thereby permitting the impedance of the transducer 300 to be directly matched to the impedance of the patient's tympanic membrane. Advantageously, this approach results in a nearly perfect impedance match with an individual patient's tympanic membrane (as opposed to a near match achieved by matching the characteristic impedance range of the humane tympanic membrane) and therefore improved efficiency of the present hearing aid device.

The acoustic path 302 may be comprised of numerous biocompatible materials as a matter of design choice. In a preferred example, however, a tube of titanium or other relatively strong, biocompatible metal is utilized. The length of the acoustic path 302 may also be selected to extend somewhat into the middle ear cavity 110, as illustrated in FIG. 4, to prevent occlusion of the path 302 by the growth of tissue over the interfacing end 316 of the path 302. In addition or alternatively, the distal or interfacing end 316 of the acoustic path 302 may be formed at an angle, such as a right angle, to prevent the collapse of the flexible tubing caused by tissue growth around the interface with the middle ear cavity 110. Also in addition to the above techniques, or alternatively, a sound conducting material may be disposed over the interfacing end 316 of the acoustic path 302 to prevent occlusion of the path by tissue overgrowth. The other end of the acoustic path 302 may be coupled to a flexible fitting, such as a silicone fitting 314, which connects to the acoustic transducer 300. Also, as may be appreciated, the acoustic path 302 may be provided with a plating system (not shown), attached to the patient's skull to provide a firm anchor.

Figure 5:
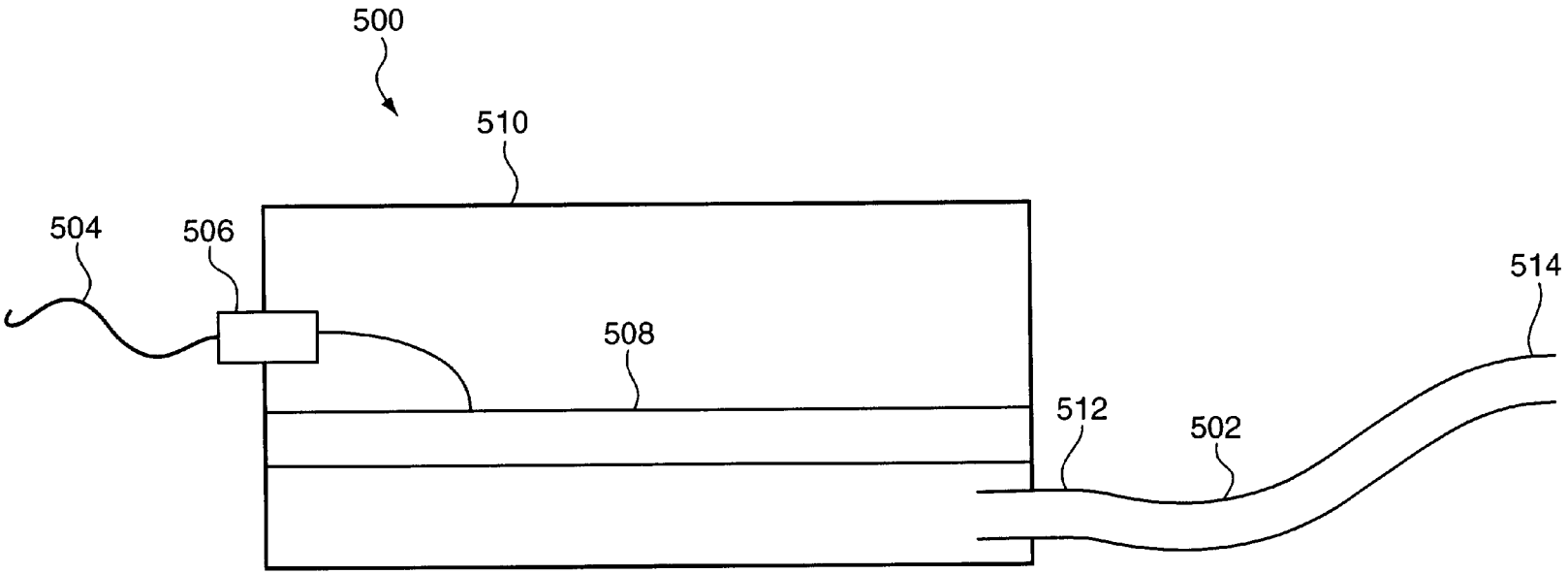
FIG. 5 illustrates another example of a transducer according to the present invention.
Figure 6:
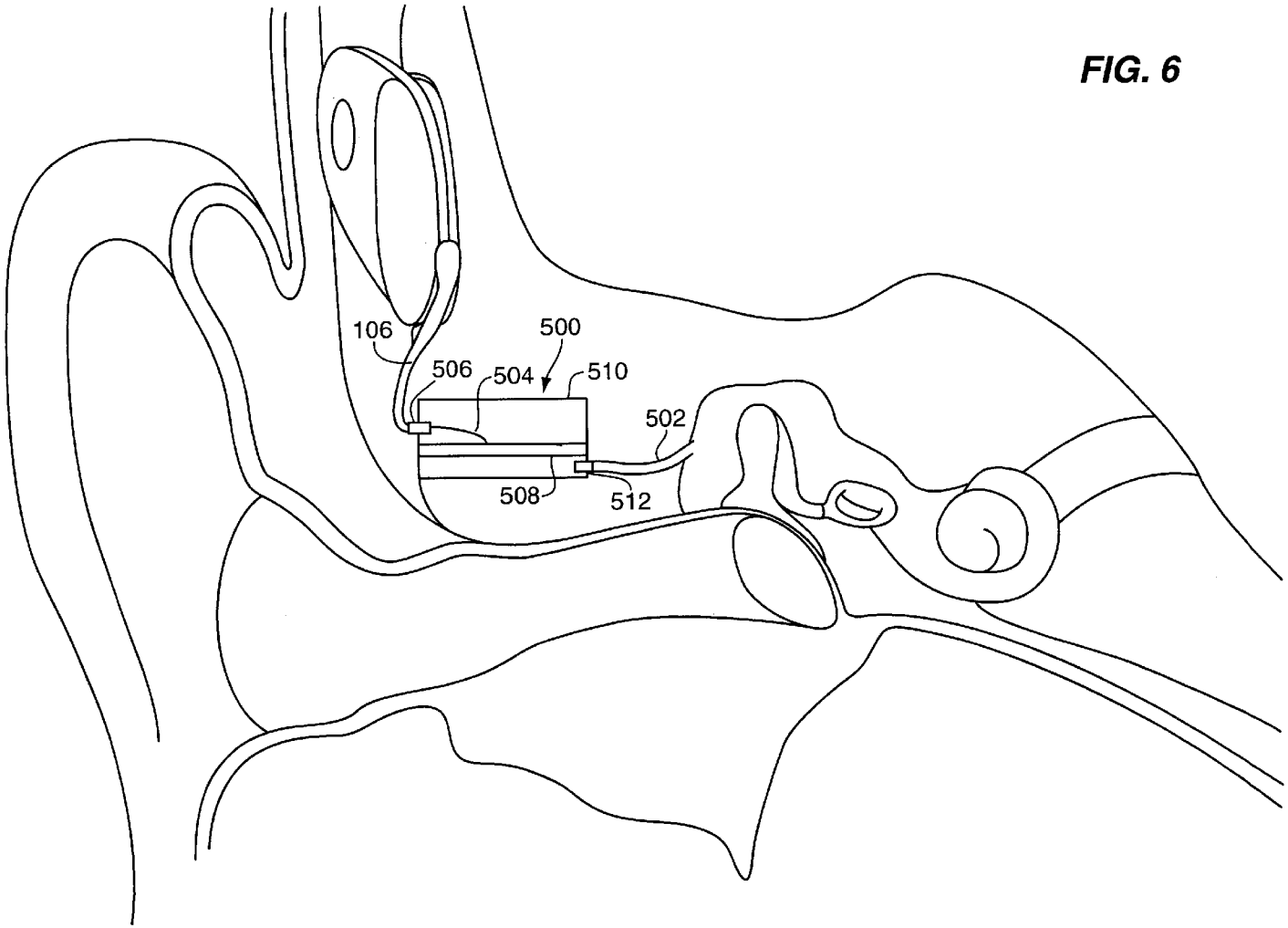
FIG. 6 illustrates an example of a hearing aid incorporating the transducer of FIG. 5.

Referring to FIGS. 5 and 6, to allow for acoustic stimulation of the tympanic membrane 112, another embodiment of the present invention provides for the use of an implanted piezoelectric acoustic transducer 500 and corresponding acoustic path 502. As with the above embodiment, the transducer 500 is an example of the transducer 108 described above to illustrate the broad concept of the present invention.

Similar to the transducer 300, the transducer 500 may be implanted within a patient's mastoid process and utilize the acoustic path 502 for transmission of acoustic signals to the middle ear 110. Alternatively, the transducer 500 may be implanted adjacent to the middle ear 110 to provide direct input of acoustic signals into the middle ear cavity 110. In this regard, the feed wire 504, which may be included in the path 106, carries drive signals to the transducer 500 to yield the desired acoustic output. More specifically, such drive signals may be provided through feedthrough 506 to drive a piezoelectric element 508. The piezoelectric element 508, in turn, converts the drive signals through electrical excitation into acoustic signals to generate the desired acoustic output to the middle ear 110 via path 502. As with the housing 322, the housing 510 is preferably hermetically sealed to protect from contamination by bodily fluids and tissue.

In a transducer, such as transducer 500, impedance matching with the characteristic impedance range of human tympanic membranes or with the impedance of an individual patient's tympanic membrane, e.g. membrane 112, is a function of the characteristics of the piezoelectric element 508. In one preferred example of the invention, the piezoelectric element may be a bimorphic disc, which produces an acoustic impedance for the transducer 500 in the range of $2\times10^4$ and $5\times10^7$ Pascal (PA) seconds per cubic meter. As may be appreciated, such acoustic impedance range corresponds to the characteristic frequency range of a human tympanic membrane, e.g. membrane 112.

As with the above embodiment, the impedance of an individual patient's tympanic membrane may be directly matched to the impedance of the transducer 500. Also similar to the above embodiment, the acoustic path 502 may be comprised of numerous biocompatible materials as a matter of design choice, but is preferably, a titanium tube or other relatively strong biocompatible metal, to prevent occlusion of the path 502. As with the acoustic path 302, the acoustic path 502 may be provided so that it somewhat extends into the middle ear cavity 110 to discourage tissue overgrowth, e.g. growth across the path opening extending into the middle ear cavity 110. In addition or alternatively, the distal end 514 of the acoustic path 502 may be formed at a right angle to prevent the collapse of the tubing caused by tissue growth around the interface with the middle ear cavity 110. Also in addition to the above techniques or alternatively, a sound conducting material may be disposed over the distal end 514 of the acoustic path 502 to prevent occlusion of the path by tissue overgrowth. The other end of the acoustic path 502 may be coupled to a nipple fitting, such as a fitting 512, which connects to the acoustic transducer 500. To provide a firm anchor, the acoustic path 502 may also be provided with a plating system (not shown), which is attached to the patient's skull.

Figure 7:
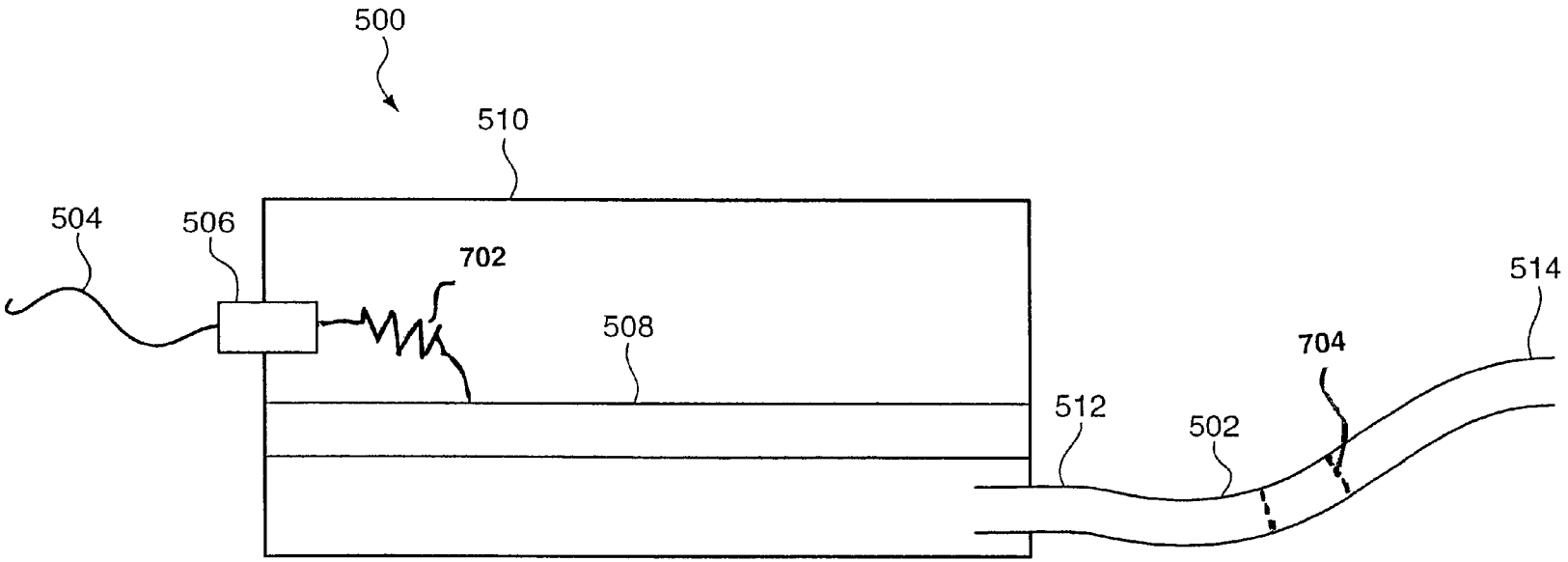
FIG. 7 illustrates another example of a transducer according to the present invention.
Figure 8:
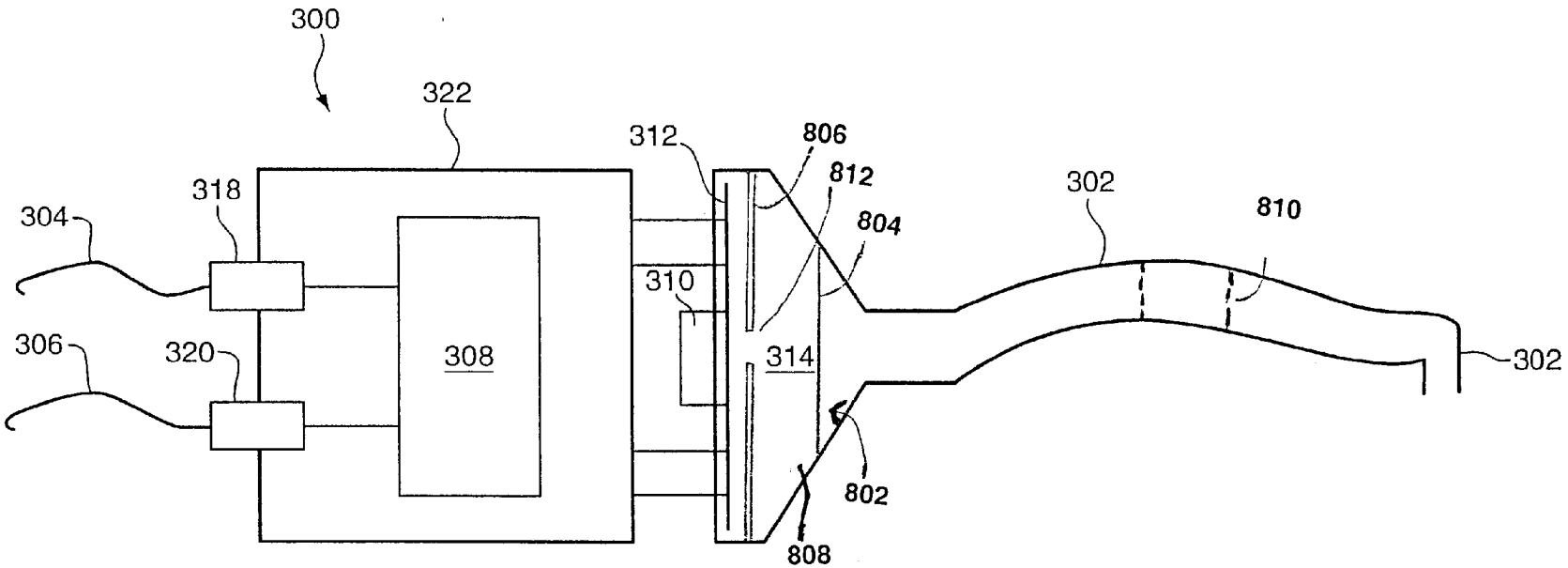
FIG. 8 illustrates another example of a transducer according to the present invention.

Referring to FIGS. 7 and 8, to allow for acoustic stimulation of the tympanic membrane 112 of a patient, the present invention also provides for the use of a damping element within a hearing aid system according to the present invention. As will be apparent from the following description, such a damping element may be included within the transducer portion, e.g. transducers, 700 and 800, or within the path portion, e.g. tubes 502 and 302, of the hearing aid system. The damping element functions to remove undesirable resonant components from acoustic signals provided to the middle ear cavity 110 of a patient. In this regard, when an acoustic path, such as paths 502 and 302, are utilized with a transducer, such as transducers 700 or 800, undesirable artificial resonant components may be introduced into the hearing aid system at various frequencies as the acoustic signals vibrate within the paths 502 and 302. Such resonant components, unless removed, degrade the natural quality of sound provided to a patient.

In this regard, the transducer 700 is substantially similar to the transducer 500 in that it includes a housing 510, a piezoelectric element 508, and feed wire 504. The transducer 700, however, also includes a damping element 702 electrically connected between the feedthrough 506 and the piezoelectric element 508 to remove artificial resonant components from the acoustic signals provided by the transducer 700. The damping element 702 may be any element that provides damping of the acoustic signals provided by the transducer 700. In one example of the present invention, the damping element is a resistor that shapes the transducer drive signals to minimize vibration of the acoustic signals within the tube 502. Alternatively, as will be appreciated by those skilled in the art, the damping element, e.g. 702, may be included within the signal processor portion 104 of the hearing aid system.

Similarly, the transducer 800 is substantially similar to the transducer 300 in that it includes feed wires, 304 and 306, feedthroughs, 318 and 320, a coil 308, a magnet 310, and acoustic diaphragm 312 included in a housing 322. The transducer 800, however, also includes a damping element 802 to remove artificial resonant components from the acoustic signals provided by the transducer 800. As with the above, example, the damping element 802 may be any element that provides damping of the acoustic signals provided by the transducer 800. In one example of the present invention, the damping element 802 includes a sealing wall 806 disposed within a chamber 808 defined by the acoustic diaphragm 312 and an isolating diaphragm 804. The isolating diaphragm 804 is a compliant diaphragm that is acoustically transparent to permit the transmission of the acoustic signals into and through the tube 302 to the middle ear cavity 110. In this characterization, it will be appreciated that the isolating diaphragm protects the internal components of the transducer 800 from contamination by fluids, e.g. in the event of an ear infection, and allows fluid to drain from the tube 302 during healing. The sealing wall 806 includes an orifice 812 to permit acoustic signals to be provided into the middle ear cavity 110 from the acoustic diaphragm 312 via the tube 302. The sealing wall 806 and orifice 812, however, provide a reduced cross section within the chamber 808 that operates in combination with the isolating diaphragm 804 to absorb resonant components of the acoustic signals generated by vibrations of such signals within the tube 302.

In an alternative embodiment, the transducer 800 may also include other forms of acoustic damping. For example, a porous material may be included within the chamber 808 to absorb resonant components. In this case, the porous material may be utilized in combination with the sealing wall 806 and diaphragm 804, or the sealing wall 806 and diaphragm 804 may be replaced by the inclusion of the porous material within the chamber 808. Some examples of the porous material may include without limitation, steel wool, porous foam and/or other material that permits transmission of acoustic signals from the transducer 800, while absorbing acoustic energy from resonant components generated by vibration of such acoustic signals within the path 302.

In another alternative embodiment of the present invention, a damping element, such as elements 704 and 810 may be included within the respective tubes 502 and 302. In this regard, the damping elements 704 and 810 may be in the form of a porous material such as steel wool or porous foam disposed within the tubes, 302 and 502, as illustrated on FIGS. 7 and 8. As with the damping elements 702 and 802 in the transducers 700 and 800, the damping elements 704 and 810 in the tubes, 302 and 502, function to absorb resonant components of the acoustic signals passing through the tubes 302 and 502 to the middle ear cavity 110 of the patient.

Figure 9:
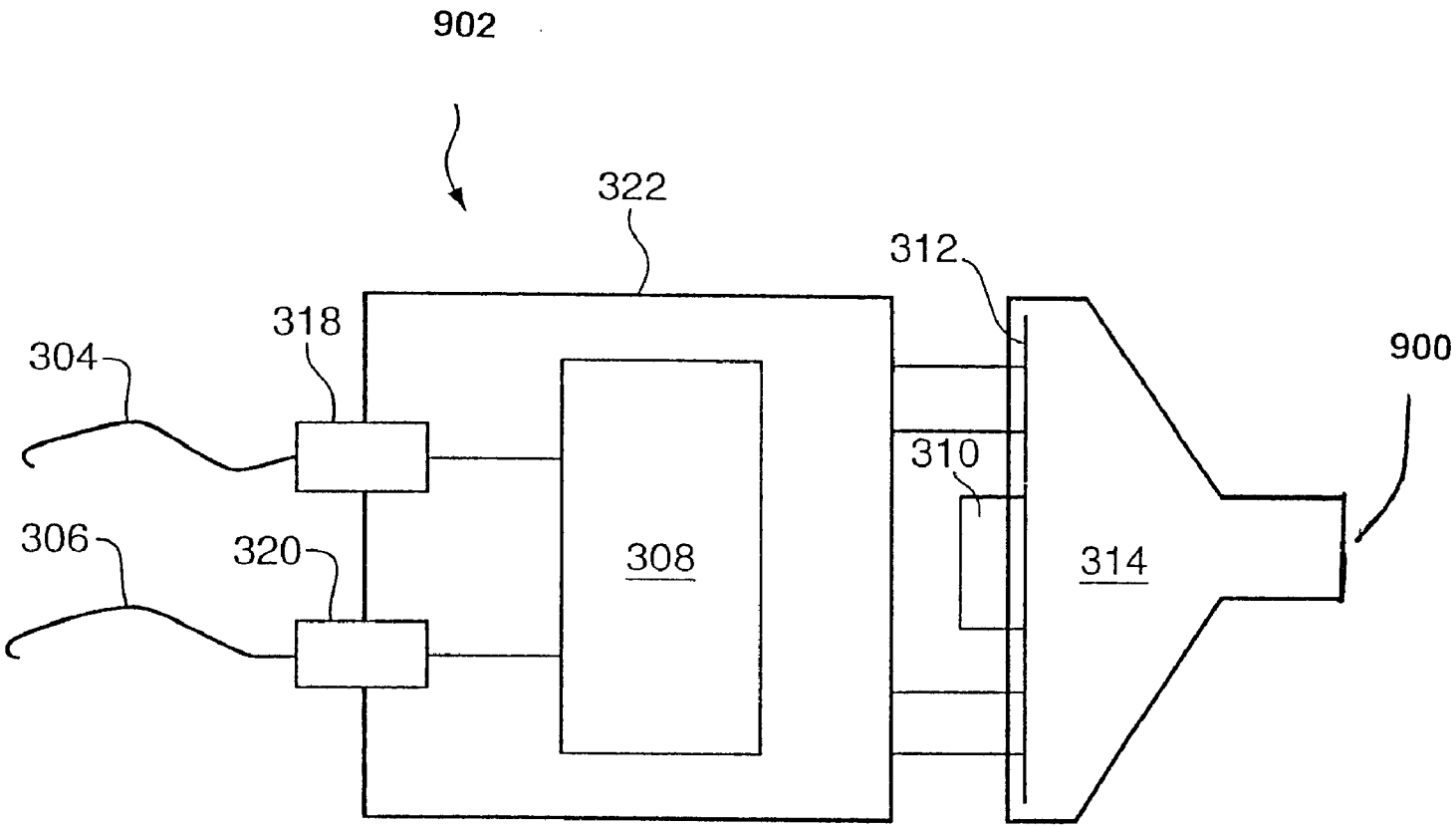
FIG. 9 illustrates another example of a transducer according to the present invention.
Figure 10:
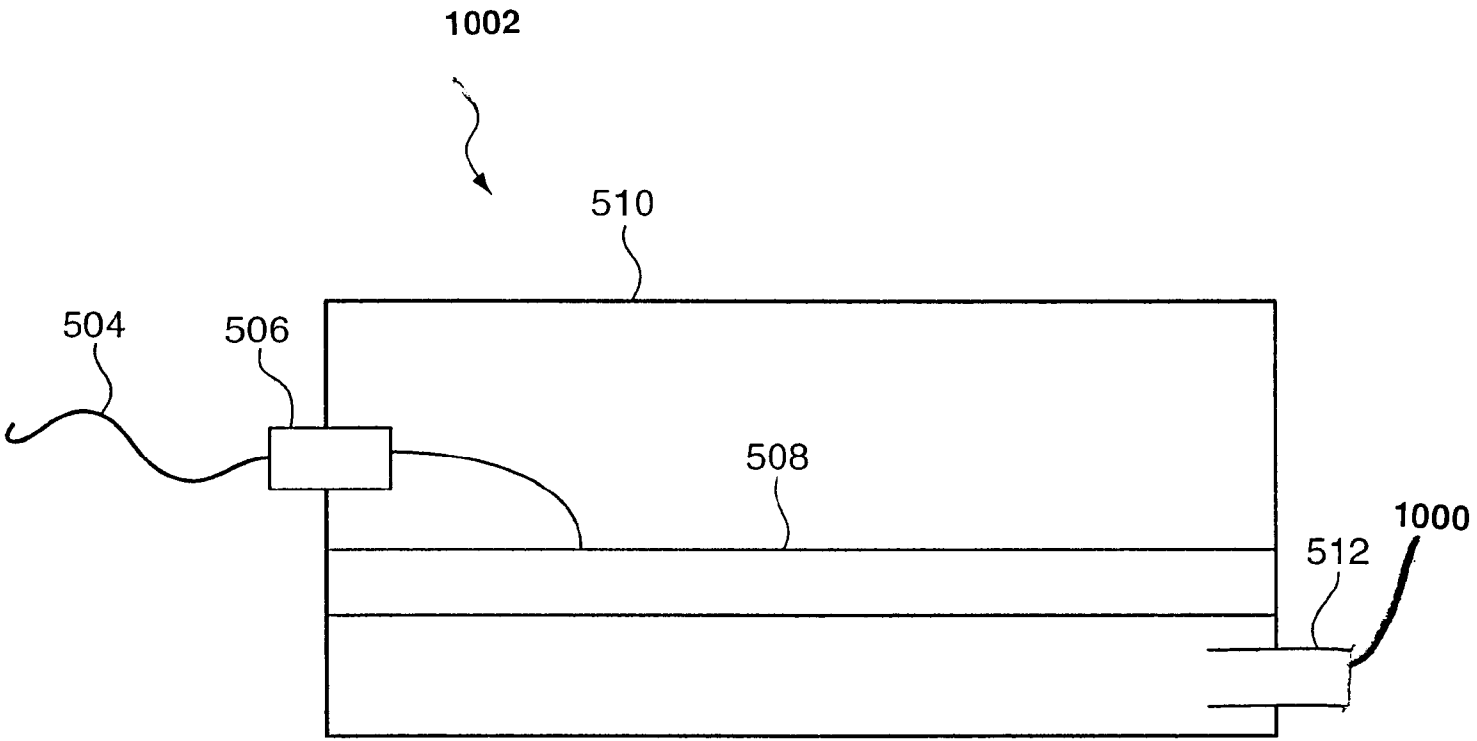
FIG. 10 illustrates another example of a transducer according to the present invention.

Referring to FIGS. 9 and 10, to allow for acoustic stimulation of the tympanic membrane 112 of a patient, the present invention also provides for the use of substantially non-resonant coupling mechanism. In this regard, the non-resonant coupling mechanism may be in the form of an acoustically transport wall such as walls 900 and 1000. Preferably, walls 900 and 1000 are compliant to permit transmission of the acoustic signals into the middle ear cavity 110 and substantially conformal to the interface with the middle ear cavity 110 to minimize contamination at the transducer, e.g. transducers 900 and 1002. In this regard, in one example of the present invention, the walls 900 and 1000 may be in the form of a titanium diaphragm. In this regard, the transducers 902 and 1002 may be located adjacent to or protruding into the middle ear cavity 110 or may be located immediately under the skin and the transducers 902 and 1002 subsequently communicating with the middle ear cavity 110 via the non-resonant coupling means.

As may be appreciated, the present invention yields a number of advantages relative to the above noted implantable hearing aid techniques. Initially, the surgical implant procedure is simplified, thereby reducing bone/tissue revision as the transducers, e.g. 300, 500, 700, 800, 902 and 1002, are not electrically or mechanically coupled to the ossicular chain. This in turn also simplifies the mounting and alignment procedure for the transducer as the transducer is implanted adjacent to the middle ear cavity 110 or within the mastoid process. In the latter case, an acoustic path is provided from the transducer (typically implanted immediately beneath the surface of the skin) to the middle ear cavity 110. Also, in the latter case, reduced patient healing time may be realized. Further, the invention provides an enhanced degree of reliability and reproducibility due to the elimination of mechanically fixed points (e.g. a mechanical interface with the ossicular chain) that may be subject to environmental pressure changes that can lead to mass loading and other undesired affects on the ossicular chain. Moreover, since the ossicular chain is not directly contacted, it is believed that natural sound quality will be enhanced. Finally, maintenance and removal procedures are simplified.

Those skilled in the art will appreciate variations of the above-described embodiments that fall within the scope of the invention. As a result, the invention is not limited to the specific examples and illustrations discussed above, but only by the following claims and their equivalents.

I claim:

1. A hearing aid device for acoustic stimulation of a tympanic membrane of a patient, the device comprising:

an acoustic signal receiver to receive acoustic sound and generate acoustic response signals;

a signal processor to process the acoustic response signals to generate transducer drive signals; and an implantable transducer to means for outputting acoustic signals into a middle ear cavity of a patient, in response to the transducer means drive signals, and thereby directly, acoustically stimulate a patient's tympanic membrane, wherein an impedance of the transducer is matched to one of a measured impedance of a patient's tympanic membrane and a predetermined characteristic impedance range for human tympanic membranes to acoustically couple the transducer and the tympanic membrane of a patient.

2. The device of claim 1, wherein the impedance of the transducer means is substantially matched within a predetermined characteristic impedance range of between $2\times10^4$ and $5\times10^8$ Pascal (PA) seconds per cubic meter.

3. The device of claim 1, wherein the impedance of the transducer means is substantially matched to a measured tympanic membrane impedance for a patient.

4. The device of claim 1, further comprising: an acoustic path—defining member positionable between the transducer means and the middle ear cavity of a patient to deliver acoustic signals from the transducer means to the middle ear cavity.

5. The device of claim 4, wherein the acoustic path—defining member comprises:

a biocompatible tubing connected at a first end to the transducer means and positionable at a distal end at an aperture in a middle ear cavity of a patient.

6. The device of claim 5, wherein the distal end of the biocompatible tubing is formed at an angle.

7. The device of claim 6, wherein the angle is substantially a right angle.

8. The device of claim 5, wherein the distal end of the tubing is adapted to—defining member further extends slightly into the middle ear cavity of the patient.

9. The device of claim 5, wherein the acoustic path comprises:

a sound conducting material disposed over the distal end of the tubing.

10. The device of claim 1, wherein the transducer means is a piezoelectric transducer.

11. The device of claim 1, wherein the transducer means is an electromagnetic transducer.

12. The device of claim 1, wherein the acoustic signal receiver is a microphone.

13. The device of claim 1, wherein the hearing aid device is a semi-implantable hearing aid.

14. The device of claim 1, wherein the hearing aid is a fully-implantable hearing aid.

15. A method for acoustic stimulation of a tympanic membrane of a patient, the method comprising:

matching an impedance of an implantable transducer to one of a measured impedance of a patient's tympanic membrane and a predetermined characteristic impedance range for human tympanic membranes, wherein the implantable transducer is acoustically couplable to a tympanic membrane of a patient;

receiving acoustic sound at an acoustic signal receiver to generate acoustic response signals;

generating transducer drive signals at a signal processor by processing the acoustic response signals; and outputting acoustic signals into a middle ear cavity of a patient from said implanted transducer in response to the transducer drive signals, wherein the acoustic signals directly, acoustically stimulate a patient's tympanic membrane.

16. The method of claim 15, wherein the matching step includes:

matching the impedance of the transducer to a measured tympanic membrane impedance for the patient.

17. The method of claim 15, wherein the matching step includes:

matching the impedance of the transducer within a predetermined characteristic impedance range of between $2\times10^4$ and $5\times10^8$ Pascal (PA) seconds per cubic meter.

18. The method of claim 15, wherein the step of coupling includes:

providing an acoustic path between the transducer and an aperture formed in the middle ear cavity of the patient.

19. The method of claim 18, wherein the step of coupling includes:

coupling a biocompatible tubing at a first end to the transducer and at a distal end to the aperture in the middle ear cavity.

20. The method of claim 19, wherein the step of coupling includes:

extending the distal end of the tubing slightly into the aperture formed in the middle ear cavity.

21. The method of claim 19, wherein the step of coupling includes:

forming an angle in the distal end of the tubing.

22. The method of claim 19, wherein the step of coupling includes:

disposing a sound conducting material over the distal end of the tubing.

23. The method of claim 15, wherein the transducer is a piezoelectric transducer.

24. The method of claim 15, wherein the transducer is an electromagnetic transducer.

25. The method of claim 15, wherein the transducer is part of a semi-implantable hearing aid.

26. The method of claim 15, wherein the transducer is part of a fully-implantable hearing aid.

27. A method for acoustic stimulation of a tympanic membrane of a patient, the method comprising:

matching an impedance of an implantable transducer to one of a measured impedance of a patient's tympanic membrane and a predetermined characteristic impedance range for human tympanic membranes, wherein the implantable transducer is acoustically couplable to a tympanic membrane of a patient;

receiving acoustic sound at one of an externally located microphone and a microphone subcutaneously-located microphone to generate acoustic response signals;

utilizing said acoustic response signals to provide transducer drive signals; and, outputting acoustic signals into a middle ear cavity of a patient from said implantable transducer in response to the transducer drive signals, wherein the acoustic signals directly, acoustically stimulate a patient's tympanic membrane.

28. The method of claim 27, wherein the matching step includes:

matching the impedance of the transducer to a measured tympanic membrane impedance for the patient.

29. The method of claim 27, wherein the matching step includes:

matching the impedance of the transducer within a predetermined characteristic impedance range of between $2\times10^4$ and $5\times10^8$ Pascal (PA) seconds per cubic meter.

30. The method of claim 27, wherein the step of coupling includes:

providing an acoustic path between the transducer and an aperture formed in the middle ear cavity of the patient.

31. The method of claim 30, wherein the step of coupling includes:

coupling a biocompatible tubing at a first end to the transducer and at a distal end to the aperture in the middle ear cavity.

32. The method of claim 31, wherein the step of coupling includes:

extending the distal end of the tubing slightly into the aperture formed in the middle ear cavity.

33. The method of claim 31 wherein the step of coupling includes:

forming an angle in the distal end of the tubing.

34. The method of claim 31, wherein the step of coupling includes:

disposing a sound conducting material over the distal end of the tubing.

35. The method of claim 27, wherein the transducer is a piezoelectric transducer.

36. The method of claim 27, wherein the transducer is an electromagnetic transducer.

37. The method of claim 27, wherein the transducer is part of a semi-implantable hearing aid.

38. The method of claim 27, wherein the transducer is part of a fully-implantable hearing aid.

* * * * *

UNITED STATES PATENT AND TRADEMARK OFFICE

CERTIFICATE OF CORRECTION

PATENT NO. : 6,726,618 B2
DATED : April 27, 2004
INVENTOR(S) : Miller

It is certified that error appears in the above-identified patent and that said Letters Patent is hereby corrected as shown below:

Column 8,
Line 41, delete “milimeters”, and insert therefor -- millimeters --.

Column 12,
Line 15, delete the word “to”.
Line 47, delete the words “-defining member further”.
Line 47, delete the word “extends”, and insert therefor -- extend --.

Signed and Sealed this

Twenty-fourth Day of August, 2004

JON W. DUDAS
*Director of the United States Patent and Trademark Office*